US005188157A

United States Patent [19]

Lee

[11] Patent Number: 5,188,157

[45] Date of Patent: Feb. 23, 1993

[54] EXTENSIBLE OIL CAP

[76] Inventor: Albert Lee, 232 Margate Rd., Timonium, Md. 21093

[21] Appl. No.: 785,267

[22] Filed: Oct. 30, 1991

[51] Int. Cl.[5] ..... B67C 11/02

[52] U.S. Cl. ..... 141/338; 141/98; 141/330

[58] Field of Search ..... 141/331, 98, 337, 338, 141/340–342, 344, 345, 311 A, 329, 330; 184/1.5, 105.1; 220/86.1, 86.2, 666, 720, 746, DIG. 33; 206/577; 123/198 R; 222/520, 523, 524

[56] References Cited

U.S. PATENT DOCUMENTS

| | | | |
|---|---|---|---|
| 1,479,660 | 1/1924 | Fuller | 141/338 |
| 1,660,442 | 2/1928 | Hampton | 141/337 X |
| 1,740,418 | 12/1929 | Donnelly | 141/337 |
| 1,912,304 | 5/1933 | Phillips | 222/523 X |
| 2,114,459 | 4/1938 | Wiswell | 184/105.1 |
| 4,058,995 | 11/1977 | Greaves | 70/431 |
| 4,112,984 | 9/1978 | Guglia et al. | 141/98 |
| 4,234,093 | 11/1980 | Tyson | 222/520 X |
| 4,286,634 | 9/1981 | Wisner | 141/95 |
| 4,338,983 | 7/1982 | Hatcher | 141/331 |
| 4,515,245 | 5/1985 | Salmon | 184/105 |
| 4,531,245 | 7/1985 | Lowd et al. | 4/144.3 |
| 4,557,378 | 12/1985 | Klebold | 206/223 |
| 4,583,668 | 4/1986 | Maynard, Jr. | 222/529 |
| 4,600,042 | 7/1986 | York et al. | 141/98 |
| 4,600,125 | 7/1986 | Maynard, Jr. | 222/81 |
| 4,703,867 | 11/1987 | Schoenhard | 220/85 |
| 4,706,719 | 11/1987 | Eversdijk | 141/98 |
| 4,856,568 | 8/1989 | Murphy et al. | 141/337 |
| 5,027,986 | 7/1991 | Heinzel et al. | 222/520 X |
| 5,033,521 | 7/1991 | Martin | 141/337 |
| 5,074,343 | 12/1991 | Tyree, Jr. | 141/331 X |

*Primary Examiner*—Henry J. Recla
*Assistant Examiner*—Casey Jacyna
*Attorney, Agent, or Firm*—Birch, Stewart, Kolasch & Birch

[57] ABSTRACT

An extensible oil cap includes an extensible telescoping funnel which has a plurality of cylindrical sections with each recesses disposed on the outer and each raised portion disposed on the inner thereof for slidably moving up and down, and tightly locking with one another and a cutting flange extended from the bottom of the telescoping funnel for making various size of an oil inlet port, and a closure with a tubular cutter for easily opening an oil can.

8 Claims, 2 Drawing Sheets

EXTENSIBLE OIL CAP

BACKGROUND OF THE INVENTION

1. Field of the Invention

The present invention relates to an extensible oil cap for funneling fluids such as a motor oil and more particularly, an improved extensible oil cap for use in an oil inlet port of an internal combustion engine so as to close the oil inlet port and use it as an extended funnel.

2. Description of the Prior Art

Various types of extensible and collapsible funnel-type caps for use in an oil inlet port of a conventional engine are well known in the art. Since such prior art funnel-type caps provide only an extended telescoping hollow tube, they suffer from a number of problems such as, for example, (a) it is difficult to lock the cap in the upright position even though the user tips the cap to side, (b) it is difficult to fit the bottom of a funnel of the cap to the oil inlet port of the engine, (c) it is difficult to lock the cap to the funnel, and (d) it requires a separate oil can opener to open an oil can when the funnel cap is operated. Such prior art extensible funnel caps are shown in U.S. Pat. No. 1,740,418 to Donnelly, U.S. Pat. No. 4,058,995 to Greaves, U.S. Pat. No. 4,112,984 to Guglia et. al., U.S. Pat. No. 4,286,634 to Wisner, U.S. Pat. No. 4,338,983 to Hatcher, U.S. Pat. No. 4,703,867 to Schoenhard, U.S. Pat. No. 4,515,245 to Salmon, U.S. Pat. No. 4,531,245 to Lowd et. al., U.S. Pat. No. 4,557,378 to Klebold, U.S. Pat. No. 4,583,668 to Maynard, Jr., U.S. Pat. No. 4,706,719 to Eversdijk, U.S. Pat. No. 4,856,568 to Murphy et. al., and U.S. Pat. No. 5,033,521 to Martin.

SUMMARY OF THE INVENTION

Accordingly, it is an object of the present invention to provide an extensible oil cap for use in a oil inlet port of engines, which eliminate the above problems encountered in a conventional extensible funnel.

Another object of the present invention is to provide an extensible and collapsible oil cap, includes a extensible telescoping funnel coupled to an oil inlet, a plurality of cylindrical sections with each "✓"-shaped recesses disposed on the outer and each raised portions disposed on the inner thereof for coupling each other, and a closure secured to an uppermost cover of the cylindrical sections, whereby when extended, the cylindrical sections are rotatably moved up and at least locked with one another.

A further object of the present invention is to provide an extensible and collapsible oil cap further includes a cutter edge extended from a tube of a closure thereof for easily opening the oil can.

Still another object of the present invention is to provide an extensible oil cap further includes a cutting flange extended from the bottom of the extended telescoping funnel thereof for matching the various sizes of the oil inlet port.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an extensible oil cap including an extensible telescoping funnel which has a plurality of cylindrical sections with each "✓"-shaped recesses disposed on the outer and each raised portion disposed on the inner thereof for slidably moving up and down, and tightly locking with one another and a cutting flange extended from the bottom of the telescoping funnel for making various size of an oil inlet port, and a closure with a tubular cutter for easily opening an oil can.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
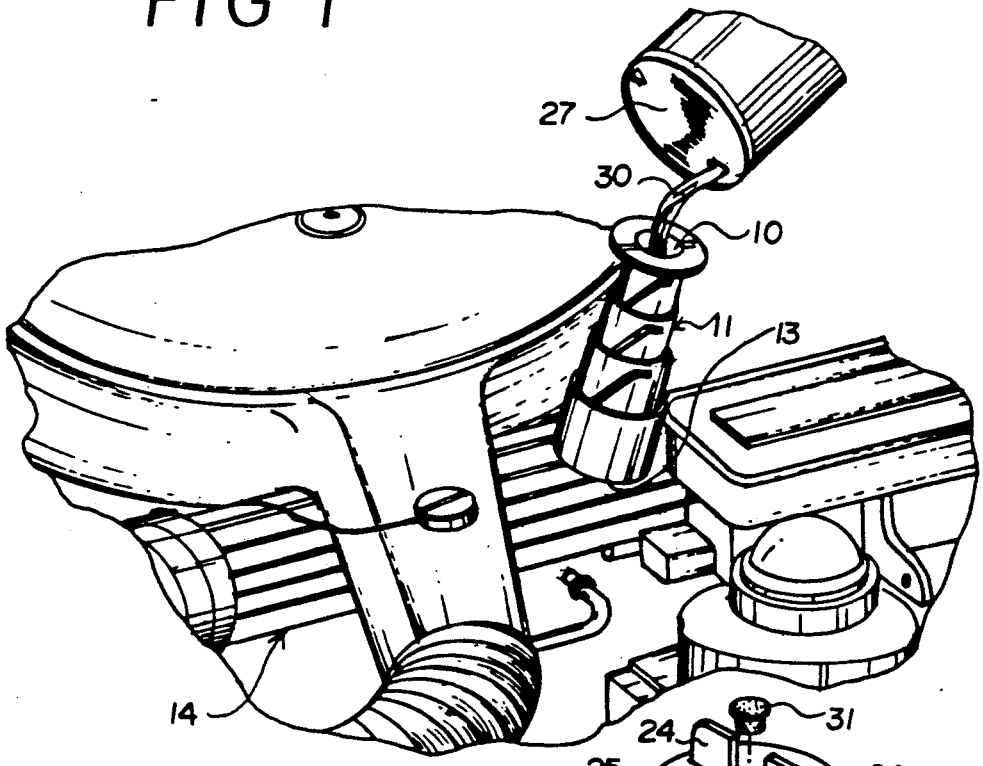
FIG. 1 is a perspective view of the extensible oil cap of the present invention showing the oil cap in extended position and attached to the oil inlet of a conventional engine.

Referring now in detail to the drawings for the purpose of illustrating preferred embodiments of the present invention, the extensible oil cap 10 for use in an oil inlet port of conventional engines as shown in FIGS. 1, 2, 3, and 4, comprises an extensible telescoping funnel 11 coupled to an oil inlet port 13 of the engine 14, and a closure 12 for closing a funnel opening 15 of the telescoping funnel 11.

Figure 2:
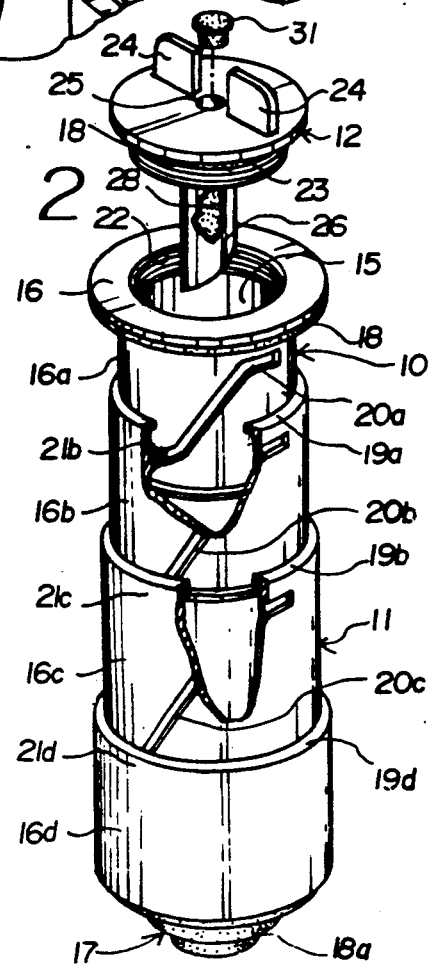
FIG. 2 is a perspective view of the extensible oil cap in extended position containing cut-away portions in order to illustrate the construction of the extensible oil cap of the present invention.
Figure 3:
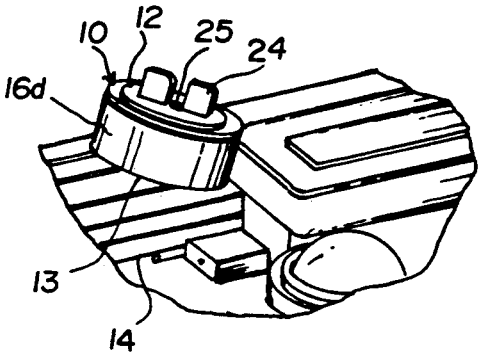
FIG. 3 is a perspective view of the extensible oil cap of the present invention in collapsed position.

As shown in FIG. 2, the extensible telescoping funnel 11 includes a plurality of cylindrical sections 16*a*, 16*b*, and 16*c*. An uppermost cover 16 outwardly extends from the cylindrical section 16*a*. A base section 17 downwardly extends from the cylindrical section 16*d*. When collapsed, sections 16*a*, 16*b*, and 16*c* fit concentrically within section 16*d* coupled to the base section 17 since each section is slightly smaller in diameter than the section below. The diameter of the uppermost cover 16 is the same as that of the cylindrical section 16*d* so that the uppermost cover 16 is slidably put on each top surface of the sections 16*b*, 16*c*, and 16*d* through a first rubber gasket 18 of the uppermost cover 16 when collapsed (FIG. 3). The plurality of cylindrical sections 16*a*, 16*b*, and 16*c* have "✓"-shaped and channeled recesses 20*a*, 20*b*, and 20*b* disposed on ;the outer surface thereof and have and raised portions 21*b*, 21*c*, and 21*d* disposed on the inner surface thereof, respectively, whereby, when extended, the cylindrical sections 16*a*, 16*b*, and 16*c* are rotatably moved up and, when collapsed, the cylindrical sections 16*a*, 16*b*, and 16*c* are rotatably moved down since the raised portions 21*b*, 21*c*, and 21*d* are slidably inserted into the recesses 20*a*, 20*b*, and 20*c*, and moved up and down along the channeled recesses 20*a*, 20*b*, and 20*c*, respectively. Finally, when both ends of the raised portions 21*b*, 21*c*, and 21*d* meet both ends recesses 20*a*, 20*b*, and 20*c*, the cylindrical sections 16*a*, 16*b*, 16*c*, and 16*d* are locked each other when extended (FIGS. 2).

The closure 12 is tightly closed with the funnel opening 15 of the cylindrical section 16*a* and the uppermost cover 16 by screwing a relative screw 22 of the cylindrical section 16*a* and uppermost cover 16, and a relative screw 23 of the closure 12. The closure 12 includes a pair of handles 24, a valve aperture 25 for receiving a pressure crankshaft case valve (hereinafter P.C.V) adapter 29 (FIG. 6), and a tubular cutter 26. The tubular cutter 26 is communicated with the valve aperture 25 and containing a filter 28 for easily opening an oil can 27 and filtering a motor oil 30 from the oil can 27. At this time, if necessary, a rubber plug 31 can be closed on the valve aperture 25 of the closure 12 (FIG. 2).

Figure 4:
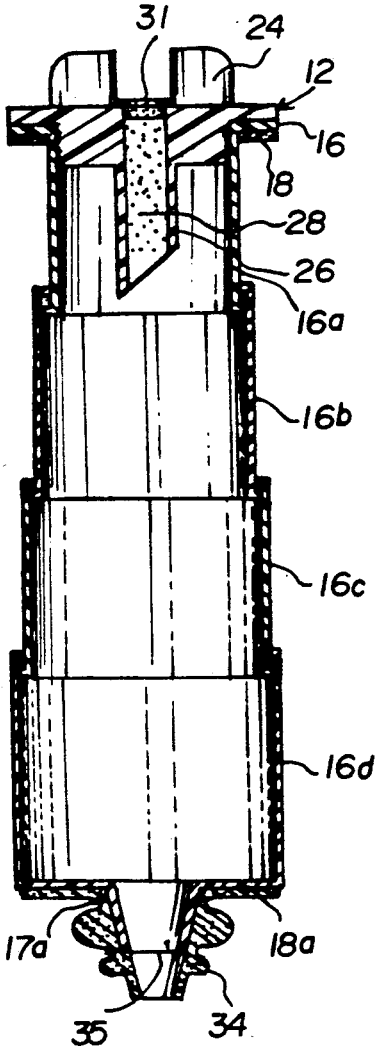
FIG. 4 is a sectional view of the extensional oil cap showing a durable convex configured flange of an alternative base section of the present invention.

FIG. 4 is a perspective view illustrating an alternative base section of the present invention.

As shown in FIG. 4, the base section 17*a* to be adapted to the oil inlet port 13 of the engine 14 includes a second rubber gasket 18*a*. The second rubber gasket 18*a* can have a double convex-configured flange 34 for matching various sizes of the oil inlet port 13 of the engines 15 by cutting along a crease line 35.

Figure 7:
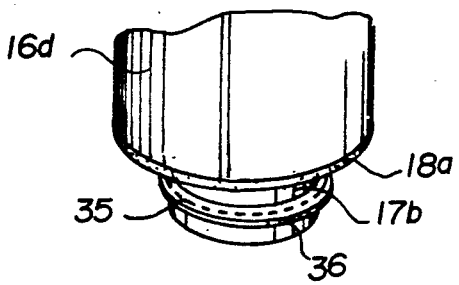
FIG. 7 is a perspective view of the extensible oil cap showing a double flange of an additional alternative base section of the present invention.

FIG. 7 is a perspective view illustrating an additional alternative base section 17*b* of the present invention.

As shown in FIG. 7, the base section 17*b* is provided with a second rubber gasket 18*a* and includes a double flange 36 extending therefrom for matching various sizes of the oil inlet port 13 of the engines 15 by cutting along a crease line 35.

Figure 5:
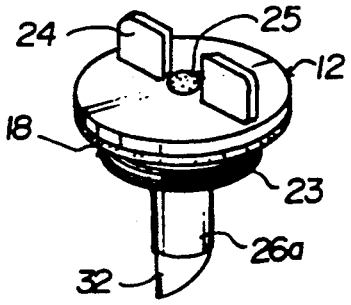
FIG. 5 is a perspective view of an alternative closure having a steel cutter of the present invention.

FIG. 5 is a perspective view illustrating an alternative tubular cutter 26*a* having a steel cutter 32 of the present invention. The steel cutter 32 is secured to the tubular cutter 26*a* by means of a conventional manner such as, for example, molding, adhesive, etc.

Figure 6:
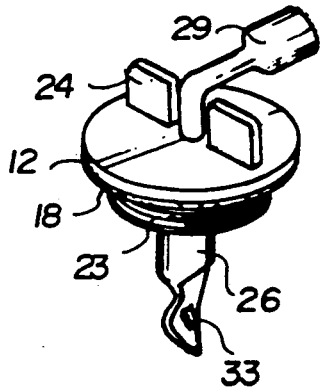
FIG. 6 is perspective view of the closure having a can opener extended from a tube attached thereto and a valve aperture attached to a pressure crankshaft case valve of the present invention.

FIG. 6 is a perspective view illustrating an additional alternative tubular cutter 26 of the present invention.

As shown in FIG. 6, the tubular cutter 26*b* extend a can opener shape 33 for using it as a oil can opener for the oil can 27.

The extensible oil cap 10 of the present invention operates as follows:

In order to pour the motor oil 30 from the oil can 27 into the engine 14, the closure 12 which is firmly in place (FIG. 2) is upwardly rotated in the counterclockwise direction by using the handles 24. At this time, the closure 12 is removed from the uppermost cover 16 and cylindrical section 16*a* through the screws 22 and 23 each other and simultaneously the extensible telescoping funnel 11 is pulled upward to the extended position and at last the plurality of cylindrical sections 16*a*, 16*b*, 16*c*, and 16*d* are tightly locked with one another by engaging the raised portions 21*b*, 21*c*, and 21*d* with the " ʃ"shaped recesses 20*a*, 20*b*, and 20*c* (FIGS. 2 and 3). Thereafter, the oil can 27 can be easily opened by using several types of tubular cutters 26, 26*a*, and 26*b* (FIGS. 5 and 6), and then the motor oil 30 from the oil can 27 is pouring into the engine 15 (FIG. 1) so as to add the motor oil 30.

In turn, in order to close the closure 12, the closure 12 is downwardly rotated in the clockwise direction by using the handles 14. At this time, the closure 12 is tightly closed to the uppermost clover 16 and cylindrical section 16*a* through the screws 22 and 23 each other and simultaneously the extensible telescoping funnel 11 is pushed back down to the closed position and at last the plurality of cylindrical sections 16*a*, 16*b*, 16*c*, and 16*d* are tightly locked with one another by engaging the raised portions 21*b*, 21*c*, and 21*d* with the " "-shaped recesses 20*a*, 20*b*, and 20*c* (FIG. 2).

If necessary, the P.C.V. adapter 29 can be inserted into the valve aperture 25 after removing the rubber plug 31 (FIG. 6). Also, according to various sizes of the oil inlet port 13 of the conventional engines 15 the double-configured flange 34 of the alternative base section 17*a* and the double flange 36 of the additional alternative base section 17*b* can be cut through the crease line 35, respectively (FIGS. 4 and 7).

Accordingly, the extensible oil cap 10 of the present invention can be easily pulled upward and easily pushed back down, can be stable in the upright position, can be fitted with any size of the oil inlet port 13 of the engines 15, and can be easily opened the oil can 27 without a separate can opener.

The invention being thus described, it will be obvious tat the same may be varied in many ways. Such variations are not to be regarded as a departure from the spirit and scope of the invention, and all such modifications as would be obvious to one skilled in the art are intended to be includes in the scope of the following claims.

What is claimed is:

1. An extensible oil cap comprising:

an extensible telescoping funnel coupled to an oil inlet-port of conventional engines, said extensible telescoping funnel including:

a plurality of cylindrical sections, said plurality of cylindrical sections defining an uppermost section, middle sections, and a lowermost section, a " "-shaped and channeled recess dispose on the outer surface of said uppermost section and said middle sections, a raised portion disposed on the upper portion of the inner surface of said middle sections and said lowermost section, an uppermost cover extending from said uppermost section, said uppermost cover and said uppermost section being provided with a funnel screw disposed on the inner surface thereof, a funnel rubber ring slidably attached to said uppermost cover, and an extended flange covered on a tubular passage extending from said lowermost section, and a closure having a closure screw disposed on the inner surface of the lower portion thereof for closing to and separating from said extensible telescoping funnel by screwing together of said funnel screw and said closure screw, said closure including:

a closure rubber ring slidably attached to the upper portion of said closure screw, a pair of handles disposed on the top thereof;

a valve aperture disposed between said pair of handles for receiving a pressure crankshaft case valve adapter, and a tubular cutter communicated with said valve aperture, whereby upon rotating upwardly and downwardly the closure, the extensible oil cap can be stably extended and collapsed so as to pour a motor oil from an oil can into the conventional engines and close the oil inlet port.

2. The extensible oil cap of claim 1, wherein each of said cylindrical section is slightly smaller in diameter than the section below so that said uppermost section and said middle sections fit concentrically within said lowermost section.

3. The extensible oil cap of claim 2, wherein said uppermost cover is the same as that of said lowermost section for slidably putting on each top surface of said middle sections and said lowermost section through said funnel rubber ring.

4. The extensible oil cap of claim 1, wherein said extended flange has a double convex-configuration containing a crease line for matching with various sizes of the port of the conventional engines.

5. The extensible oil cap of claim 1, wherein said extended flange has a double configuration containing a crease line for matching with various sizes of the oil inlet port of the conventional engines.

6. The extensible oil cap of claim 1, wherein said tubular cutter contains a filter disposed within the upper portion thereof for filtering the motor oil from the oil can while the pressure crankshaft case valve adapter is used.

7. The extensible oil cap of claim 6, wherein said tubular cutter defines a tube and a steel cutter attached to said tube.

8. The extensible oil cap of claim 6, wherein said tubular cutter defines said tube and a can opener attached to said tube.

* * * * *